United States Patent [19]

Miyahara et al.

[11] 4,321,459

[45] Mar. 23, 1982

[54] ELECTRICAL HEATING MOLDED-ELEMENT COMPRISING INORGANIC FIBERS

[75] Inventors: Yoshihisa Miyahara, Yokohama; Kimimasa Kobayashi, Kumagaya; Yawara Kobayashi, Hanyu; Tsuneo Harada, Kumagaya, all of Japan

[73] Assignees: Nichias Corporation; Riken Corporation, both of Tokyo, Japan

[21] Appl. No.: 128,121

[22] Filed: Mar. 7, 1980

[30] Foreign Application Priority Data

Mar. 16, 1979 [JP] Japan ..... 54-30652
Mar. 27, 1979 [JP] Japan ..... 54-35124

[51] Int. Cl.[3] ..... H05B 3/48; H05B 3/66

[52] U.S. Cl. ..... 219/544; 219/213; 219/345; 219/548; 219/553

[58] Field of Search ..... 219/213, 345, 390, 460, 219/464, 536, 544, 545, 548, 549, 552, 553; 428/74, 75, 80; 13/22, 25; 252/312

[56] References Cited

U.S. PATENT DOCUMENTS

| | | | |
|---|---|---|---|
| 2,889,445 | 6/1959 | Wolf | 219/345 |
| 2,952,761 | 9/1960 | Smith-Johannsen | 219/544 X |
| 3,235,712 | 2/1966 | Watson | 219/549 |
| 3,479,490 | 11/1969 | Stark | 219/544 |
| 3,500,444 | 3/1970 | Hesse et al. | 219/544 |
| 3,664,013 | 5/1972 | MacGuire | 219/213 X |
| 3,697,728 | 10/1972 | Stirzenbecher | 219/548 |
| 3,786,162 | 1/1974 | Colson | 219/390 X |
| 3,866,017 | 2/1975 | Keren et al. | 219/390 |
| 3,870,861 | 3/1975 | Werych | 219/464 X |
| 3,968,281 | 7/1976 | Erickson | 219/213 X |

*Primary Examiner*—Volodymyr Y. Mayewsky
*Attorney, Agent, or Firm*—Thomas R. Morrison

[57] ABSTRACT

An improved electrical heating molded-element or unit in which a heating wire is embedded or confined in one side of a fibrous layer formed by molding inorganic fibers into a given thickness, characterized in that a portion of said element or unit in the vicinity of the embedded heating wire is treated to provide a zone in which the density, heat conductivity and fire resistance are greater than those of the remainder. With this electrical heating molded-element or unit, it is possible to extract effectively the amount of heat generated by heating wire. This element or unit can be used over an extended period of time with safety but without causing local disintegration thereof owing to the expansion or contraction of the heating wire.

6 Claims, 7 Drawing Figures

ELECTRICAL HEATING MOLDED-ELEMENT COMPRISING INORGANIC FIBERS

BACKGROUND OF THE INVENTION

The present invention is concerned with improvements in or relating to an electrical heating molded-element or unit comprising inorganic fibers and adapted for use in the wall of an electric furnace or the like.

Fibrous molded blocks comprising heat-resistant inorganic fibers added with minor amounts of binders have recently been used in the wall of an electric furnace or the like in place of brick. In addition, an electrical heating molded-element has been put to practical use, which is manufactured by embedding or confining a heating wire in one side of such a block.

The above-mentioned molded-element comprising inorganic fibers is light in weight and excels in heat insulation. Further, the electrical heating molded-element having a heat wire embedded in its one side has the advantage that it requires no specially designed means for supporting the heating wire, and is characterized in that it is safer to use due to the fact that the heating wire is not exposed to the outside. However, the heating element of this type is disadvantageous in that the heat conduction occurring from the embedded heating wire to the inside of an electric furnace through the fibrous layer is limited thanks to the good heat insulation of inorganic fibers. Another problems results from the fact that the temperature of a portion of the heating element around the heating wire is markedly higher than that in the furnace during use. This causes premature deterioration or degradation of said portion. Still another problems arises due to the low strength of the fibrous molded-element; in some cases, the molded-element may locally disintegrate with the expansion and contraction of the heating wire.

SUMMARY OF THE INVENTION

The present invention has been accomplished with a view to providing a solution for the above-mentioned problems, and has for its main object to provide an electrical heating molded-element or unit comprising an inorganic fibrous molded-body having a heating wire embedded or confined therein, said element or unit being designed such that the amount of heat generated by the heating wire is effectively extracted therefrom, and such that it is used over an extended period of time with safety but without causing local disintegration of the element owing to the expansion or contraction of the heating wire, while the heating wire is retained in a stable state.

According to the present invention, the above-mentioned object is achieved by providing an improved electrical heating molded-element or unit in which a heating wire is embedded or confined in one side of a fibrous layer formed by molding inorganic fibers into a given thickness, characterized in that a portion of said element or unit in the vicinity of the embedded heating wire is treated to provide a zone in which the density, heat conductivity and fire resistance are greater than those of the remainder. The thus treated zone has the effects of increasing the dissipation of heat occurring from the heating wire to the surface of the molded-element through the fibrous layer; diminishing a difference between the temperature of the heating wire and that prevailing outside the fibrous molded-element; and inhibiting the thermal deformation of the heating wire to prevent local disintegration of the fibrous molded-element.

BRIEF DESCRIPTION OF THE DRAWINGS

Other and further features and advantages of the electrical heating molded-element or unit of the present invention will appear to those skilled in the art from the following description, examples and claims, taken together with the drawings wherein:

DESCRIPTION OF PREFERRED EMBODIMENTS

Figure 1:
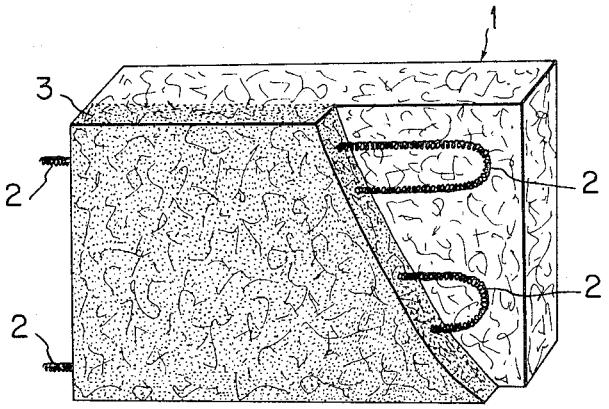
FIG. 1 is a perspective view, partially cut away, of one embodiment of the electrical heating molded-element comprising inorganic fibers according to the present invention.

Referring now to FIG. 1, there is shown one embodiment of the electrical heating molded-element or unit according to the present invention. An inorganic-fibrous molded-layer generally shown at 1 and forming part of the electrical heating molded-element is obtained by molding into a plate heat-resistant inorganic fibers such as ceramic fibers, alumina fibers or the like fibers, added to which have been minor amounts of inorganic or organic binders. A heating wire 2 is embedded in the fibrous layer of one side of the molded layer 1 as viewed in the cross-sectional direction. As illustrated, the heating wire 2 is completely confined in the fibrous layer; however, it is preferably located as close to the surface of the molded element as possible. The heating wire may be at least partly on the surface of molded element.

A portion of the fibrous molded layer 1 in which the heating wire 2 is embedded is impregnated with an inorganic dispersion liquid excelling in heat resistance, such as colloidal silica, colloidal alumina or the like to form a layer 3 impregnated and deposited with refractories.

The electrical heating molded-element or unit comprising inorganic fibers according to the present invention can easily be obtained by the following manner.

Figure 2:
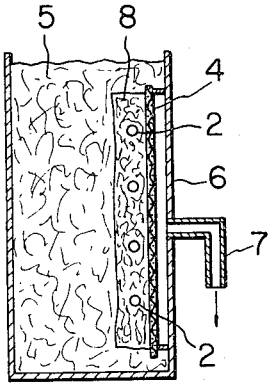
FIG. 2 is a longitudinally sectional view of a mold for producing the element of FIG. 1 the same.
Figure 3:
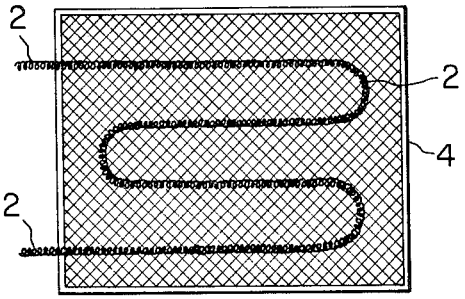
FIG. 3 is a front view of a mold provided with a heating wire.

As shown in FIGS. 2 and 3, the heating wire 2 is supported on one side of an air-permeable mold 4 formed of, e.g., a network plate by suitable means (not shown). The mold 4 is then immersed in a fiber-dispersed liquid 5 stored in a tank 6, said liquid being composed of heat-resistant inorganic fibers added with water and minor amounts of binders. A suction pipe 7 is so arranged that it opens into the tank 6. Application of a suction force on one side of the mold equipped with no heating wire by means of the suction pipe 7 causes the fibers to be deposited and built up on the other side of the mold having the heating wire 2, so that the heating wire 2 is coated with the thus accumulated layer 8. Upon the resultant coating reaching a given thickness, the mold 4 is withdrawn from the dispersion liquid and the fiber-accumulated layer is removed from the mold followed by drying, whereby a fibrous molded layer having the heating wire embedded therein is obtained. This fibrous layer is finally impregnated with collidal silica or colloidal alumina to form the refractories-impregnated and deposited layer 3. In this way, the above-mentioned electrical heating moded-element or unit comprising inorganic fibers is obtained.

According to the present method as mentioned just above, embedding of the heating wire is effected simultaneously with the formation of the fibrous layer. This renders the heating wire embedding operation easy and simple, and ensures that an uniformly united fibrous molded-element for generating heat is obtained, in which the heat-resistant inorganic fibers are evenly mixed with the binders.

In the thus constructed fibrous molded-element for generating heat, the refractory layer is impregnated and deposited on one side of the fibrous molded layer 1 in which the heating wire 2 is embedded. Thus, since the one side of the molded element is set and has higher density and heat conductivity than those of the other side, it is possible to extract effectively the amount of heat generated by the heating wire 2 to the surface of the molded element through the highly heat-conductive and refractory layer 3.

The above-mentioned good heat dissipation gives rise to a limited difference between the temperature of the heating wire and that prevailing outside the molded-element. Accordingly, superheating of the heating wire and premature deterioration of the fibers enveloping the heating wire are prevented, thus providing longer service life to the molded element.

As explained hereinbefore, the heating wire 2 is embedded in the layer 3 impregnated and deposited with refractories, said layer being rendered rigid so as to have a high density. This ensures prevention of occurrence of unfavorable events such as disintegration of the fibrous layer or partial projection of the heating wire from the molded-element caused by the expansion and contraction of the heating wire which take place at the time when the temperature rises or drops.

The molded-element provided only on the side having the heating wire embedded therein with the refractories-impregnated and deposited layer still is generally of light weight, and is formed together with said layer as an integral unit. This construction is further advantageous in that, even when it is subjected to repeated temperature drop and rise, separation of the refractory layer does not occur.

Preferably, the thickness of the layer 3 impregnated and deposited with refractories is substantially the same as a distance from the surface of the molded element to the heating wire embedded therein, and should be determined taking into account the fact that, in the thickness is greater than required, the fibrous layer 1 suffers a lowering of the heat insulating properties whereas, in a too small thickness, effective extraction of the amount of heat produced by the heating wire is not achieved. In the foregoing embodiment, the refractory layer 3 is obtained by impregnation of colloidal silica, colloidal alumina or the like; however, it may be obtained by impregnation of a liquid prepared by adding refractory powders such as alumina, zirconia or silica powders to a liquid medium containing binders, for example, ethyl silicate.

Figure 4:
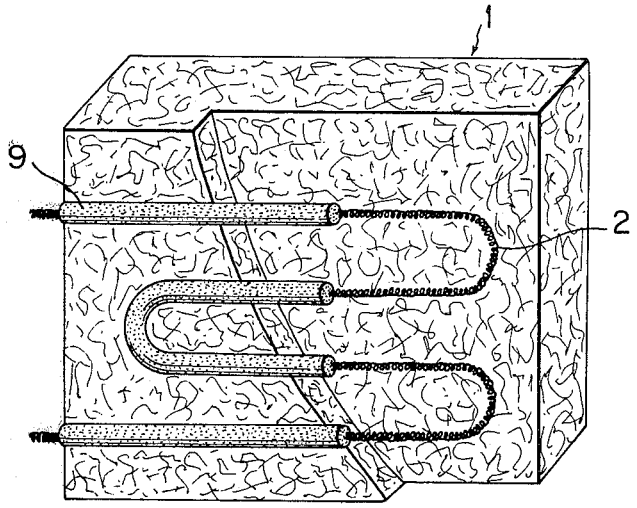
FIG. 4 is a perspective view, partially cut away, of another embodiment of the electrical heating molded-element comprising inorganic fibers according to the present invention.

Turning now to FIG. 4, there is shown another embodiment of the present invention. In this embodiment, the heating wire 2 is covered with a rigid sheathing 9 that excels in both heat resistance and heat conductivity. This sheathing 9 is preferably formed of a blend prepared by kneading, e.g., ceramic short-fibers and refractory inorganic binders with water, a blend prepared by adding thereto alumina or silica powders, or a blend prepared by kneading, e.g., alumina, silica or zirconia powders with ethyl silicate or an alcohol.

As illustrated, the sheathed (9) heating wire 2 is embedded in a state where it is partly found on the fibrous molded-element; however, it may competely be confined in a portion thereof which lies as close to the surface of the molded element as possible.

This embodiment can easily be attained by the following manner.

Figure 5:
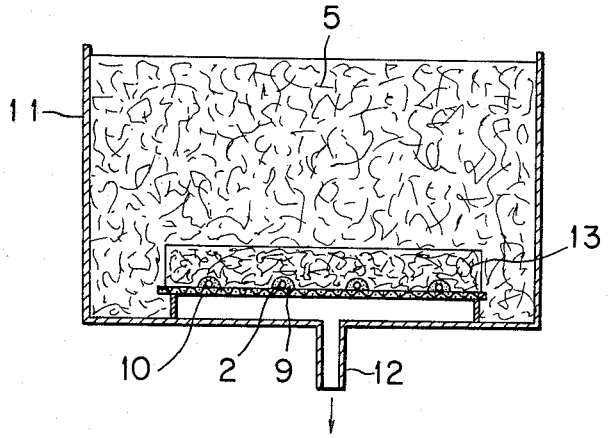
FIG. 5 is a longitudinally sectional view of a mold for producing the device of FIG. 4.
Figure 6:
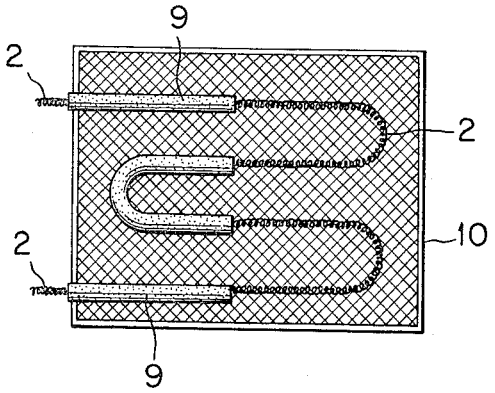
FIG. 6 is a front view of a mold provided with a sheathed heating wire.

As shown in FIGS. 5 and 6, the sheathed heating wire 2 is supported on one side of an air-permeable mold 10 formed, e.g., a network plate by suitable means (not shown). The mold 10 is then immersed in a fiber-dispersed liquid 5 stored in a tank 11, said liquid being composed of heat-resistant inorganic fibers added with water and minor amounts of binders. A suction pipe 12 is so arranged that it opens into the tank 11. Application of a suction force on one side of the mold equipped with no sheathed heating wire by means of the suction pipe 12 causes the fibers to be deposited and built up on the other side of the mold having the sheathed heating wire 2, so that the sheathed heating wire 2 is coated with the thus accumulated layer 13. Upon the resultant coating reaching a given thickness, the mold 10 is withdrawn from the dispersion liquid and the accumulated layer is removed from the mold followed by drying, whereby a fibrous molded layer having the sheathed heating wire is obtained.

According to the present method as mentioned just above, embedding of the sheathed heating wire is effected simultaneously with the formation of the fibrous layer. This renders the sheathed heating wire-embedding operation easy and simple, and ensures that an uniformly united fibrous molded-element for generating heat is obtained, in which the heat-resistant inorganic fibers are evenly mixed with the binders.

In an alternative method for applying the sheathing 9 on the heating wire 2, a space is left around the portion in which the heating wire 2 having no sheathing is to be embedded at the step of forming the fibrous molded-element. The aforesaid sheathing material is then filled or cast in the space followed by drying and setting, thereby forming a sheathed wire. In a further alternative method, the heating wire 2 having no sheathing is first embedded in a given portion of the fibrous layer while a space is left therearound at the step of forming the fibrous molded-element. The aforesaid sheathing material is then filled or cast in the space followed by drying and setting, thereby forming a sheathed wire.

In the thus constructed fibrous molded-element for generating heat, the heating wire 2 is coated with the rigid and heat-conductive sheathing 9. Thus, since the sheathing 9 acts as a heat-conductive medium, it is possible to extract most effectively the amount of heat produced by the heating wire 2 to the surface of the molded element through the fibrous layer.

The above-mentioned good heat dissipation gives rise to a limited difference between the temperature of the heating wire and that prevailing outside the molded element. Accordingly, superheating of the heating wire and premature deterioration of the fibers enveloping the heating wire are prevented, thus providing longer service life to the molded element.

As explained hereinbefore, the heating wire 2 is coated with the rigid sheathing 9. This ensures prevention of occurrence of unfavorable events such as disintegration of the fibrous layer or partial projection of the heating wire from the molded element caused by the transformation of the heating wire which takes place at the time when the temperature rises or drops.

Figure 7:
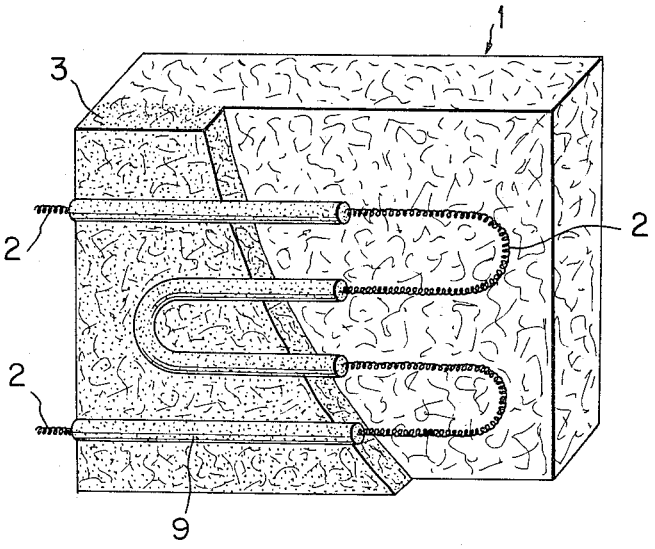
FIG. 7 is a perspective view, partially cut away, of still another embodiment of the electrical heating molded-element comprising inorganic fibers according to the present invention.

FIG. 7 shows still another embodiment of the present invention. In this embodiment, a portion of the fibrous layer having the sheathed (9) heating wire 2 embedded therein is provided with the refractories-impregnated and deposited layer 3 which is similar to that shown in FIG. 1. This embodiment is further advantageous in that the refractory layer 3 makes, in association with the sheathing 9, more improvements in the heat dissipation, and the prevention of deterioration and local disintegration of the fibers.

The present invention will be further elucidated by way of the following non-restrictive examples. In these examples, provision was made for an electrical heating molded-unit A in which a heating member obtained by shaping a 1.7 mmϕ heating wire (Fe-al-Cr based wire) into a 10 mmϕ coil was embedded in one side of a fibrous molded-body obtained by lamination of alumina fibers with the aid of binders; an electrical heating molded-unit B (according to the present invention) in which a slurry obtained by kneading 73 to 74% by weight of alumina ($Al_2O_3$) powders and 26 to 27% by weight of silica ($SiO_2$) powders with a solution containing ethyl silicate as the binder was impregnated in the side of the unit A having the heating wire embedded therein followed by drying, thereby to form a refractories impregnated and deposited layer in a zone adjacent the heating wire; an electrical heating molded-unit C obtained by depositing and surrounding the coiled heating member with a slurry formed by kneading 73 to 74% by weight of alumina ($Al_2O_3$) powders and 26 to 27% by weight of silica ($SiO_2$) powders with a solution containing ethyl silicate as the binder to form a sheathing around the heating member, and by embedding the thus sheathed heating member in one side of a fibrous molded-body formed by laminination of alumina fibers with the aid of binders; and an electrical heating molded-unit D obtained by impregnating the surface of said one side of the unit C with a slurry prepared by kneading 73 to 74% by weight of alumina ($Al_2O_3$) powders and silica ($SiO_2$) powders with a solution containing ethyl silicate as the binder and drying the resultant body such that a refractories-impregnated and deposited layer is formed on said surface. Then, test furnaces Ao, Bo, Co and Do of the same dimension were made using the units A, B, C and D as a furnace wall also serving as heat generating source. Using these test furnaces, durability comparison testing was carried out.

Test 1

At a constant current density of 4 Amp/mm$^2$, heat was applied on the respective test furnaces to maintain the temperatures therein at 1200° C. in an energized state by adjusting the area of an opening formed in each furnace.

Test Results

The test furnaces Bo and Do could be continuously run for 2000 hours without failure, and could stand further use. In the test furnace Co, the surface of the side having no refractories was slightly damaged on a 2000 hours run, yet it could stand further use. In the test furance Ao, however, the heating wire was burned out on a 170 hours run.

Test 2

The test furnaces used in Test 1 each were repeatedly subjected to a test cycle wherein the furnace was heated from room temperature to 1000° C. at a constant current density of 4 Amp/mm$^2$; then maintained at that temperature for 10 hours; and finally cooled down to room temperature by de-energization.

Test Results

In the test furnaces Bo and Do, the test cycle could be repeated 200 times without any failure, yet they could stand further use. In the test furnace Co, the surface of the fibrous molded-unit was cracked to a less degree, yet it could stand further use. However, in the test furnace Ao, the surface of the fibrous molded-unit was so damaged after 18 runs that local disintegration thereof and separation of the heating wire took place; it follows that this furnace could not stand subsequent testing.

As explained in the foregoing, the present invention provides an improved electrical heating molded-element or unit in which a heating wire is embedded or confined in one side of a fibrous layer formed by molding inorganic fibers into a given thickness, characterized in that a portion of said element or unit in the vicinity of the embedded heating wire is treated to provide a zone of which the density, heat conductivity and fire resistance are greater that those of the remainder. According to the present invention, the thus treated zone permits the amount of heat produced by the heating wire embedded in the fibrous layer to be effectively extracted to the outside of the molded element or unit without having an adverse influence on the properties of the inorganic fibrous molded-element or unit, and has the effects of preventing the disintegration of the fibrous layer and the deterioration of the fibers adjacent the heating wire which are caused by the expansion and contraction of the heating wire. Consequently, the electrical heating molded-element or unit comprising inorganic fibers according to the present invention is more advantageously used in heat-generating members such as the wall of an electric furnace.

What is claimed is:

1. An electrical heating element comprising:

a heating wire;

a layer of inorganic fiber molded from a slurry into a fibrous molded layer having first and second opposed sides;

said heating wire being embedded into said fibrous molded layer closer to said first side than to said second side;

a treated zone in said layer extending at least from said first side to said heating wire;

said treated zone including a sheathing of an inorganic material molded on said heating wire; and said sheathing having a density and heat conductivity substantially higher than the remainder of said layer whereby heat dissipation through said first side and durability of said heating element are improved.

2. The electrical heating element as recited in claim 1, in which said sheathing includes an impregnated layer prepared by impregnating and depositing a refractory material on the side of the fibrous layer having the heating wire embedded therein from the surface of said first side at least to said heating wire.

3. The electrical heating as element recited in claim 2, said impregnated layer includes impregnation by one of colloidal silica and colloidal alumina.

4. The electrical heating element as recited in claim 2, in which said impregnated layer includes impregnation by at least one of alumina, ziroconia and silica powders in a solution containing binders.

5. The electrical heating element as recited in claim 1, in which said sheathing is molded to said heating wire before molding said fibrous molded layer thereon and said sheathing includes one of a slurried blend prepared by kneading ceramic short-fibers and refractory inorganic binders with water, a slurried blend prepared by adding thereto one of alumina and silica powders, a slurried blend prepared by kneading at least one of alumina, silica and ziroconia powders with ethyl silicate, and a slurried blend prepared by kneading at least one of alumina, silica and ziroconia powders with an alcohol.

6. The electrical heating element as recited in claim 1, wherein said sheathing includes a first sheathing molded to said heating wire before molding said fibrous molded layer thereon and a second sheathing including an impregnated layer prepared by impregnating said first side of said molded layer to a depth at least to said heating wire with a refractory material, said refractory material being effective to impart substantially higher heat conductivity from said heating wire to said first side than the remainder of said molded layer.

* * * * *